United States Patent [19]

Spencer

[11] Patent Number: 4,763,598

[45] Date of Patent: Aug. 16, 1988

[54] MULTI-PURPOSE DECK PANELS

[76] Inventor: William P. Spencer, 14031 81st Ave. N., Maple Grove, Minn. 55369

[21] Appl. No.: 914,153

[22] Filed: Oct. 1, 1986

[51] Int. Cl.[4] ..... B63B 17/00

[52] U.S. Cl. ..... 114/361; 114/201 R

[58] Field of Search ..... 114/71, 85, 349, 361–364, 114/201 R; 182/77, 95, 96

[56] References Cited

U.S. PATENT DOCUMENTS 2,743,861 5/1956 Mattis et al. ..... 182/77

4,567,845 2/1986 Smith ..... 114/363

FOREIGN PATENT DOCUMENTS 1150568 1/1958 France ..... 114/349

*Primary Examiner*—Joseph F. Peters, Jr.

*Assistant Examiner*—Jesûs D. Sotelo

[57] ABSTRACT

The structure consists of multiple panels attached to each other and to the deck of a boat. These panels are movable to more than one position and have different uses in each position. When lowered into a cabin area they provide a large opening in the deck and provide an additional useful function such as the formation of seats or of ladder steps. When raised they form a part of the deck and close the opening in the deck to provide weather protection and security for the cabin.

2 Claims, 2 Drawing Sheets

MULTI-PURPOSE DECK PANELS

BACKGROUND OF INVENTION

This invention will provide a unique solution to a problem faced by operator's of a wide variety of small boats. That is to have an open forward deck arrangement for easy access, and a closed hard forward deck for weather protection and security. (A hard deck refers to one made of a material such as fiberglass, aluminum, wood or steel as apposed to a canvas cover). Currently available designs provide only one or the other. Boats with closed cabins provide relatively good weather protection and security but are restrictive when the weather is nice and people would prefer to be outside. Open boats such as the very popular open bow designs offer good access to the bow for seating, handling lines at docks, for beaching, and are enjoyable places to sit in good weather. However, they offer little or no security and when covered with snap on canvass the bow area can't be used as a cabin because of the permanently molded in seats. Even if the seats were detachable, the problem of what to do with them when the cabin was being used would remain. Small boats have very limited storage and even if they could be folded away, the cabin cover would still be canvas rather than a much more secure hard deck.

A derivative of the invention will provide a solution to a problem faced by operator's of small cruisers. It is very difficult and for many people literally impossible to gain access to the front decks of these boats to handle lines when mouring or simply to enjoy sitting and riding there. Access to the front deck of many of these boats is through hatches, many of which are difficult even for agile children, or around the side of the boat cabin on narrow ledges. Ledges are kept narrow because they infringe on limited cabin space. Some boats require crawling over the dash and windshield. None of these arrangements make access easy or convenient and many aren't safe.

SUMMARY OF THE INVENTION

1. Cuddy Cabin/Open Bow Conversion

This problem will be solved by utilizing multi-purpose panels that are integrated into a boat deck. The unique feature of this invention is the use of deck panels for more than one purpose thus providing many advantages and eliminating many disadvantages of other designs which attempt to achieve the same or similar purpose.

Two specific designs are described in this application, but nearly any watercraft, from small open runabouts to large cruisers and many sailboats, could achieve added utility by integrating into their deck caps some version of this invention.

Open bow/cuddy conversion boats are possible because the problem of what to do with the hard deck when used as an open bow boat is solved. The multi-purpose deck sections have folded down to form the seats and at the same time open up the whole bow area of the boat. When used as a cuddy cabin cruiser, the problem of what to do with the seats that would otherwise severely restrict the cabin area is also solved. They are raised to become the hard deck and thus enclose the cabin. There are no parts to be removed and left on shore or stored on board since the panels are always in use as either seats or as part of the deck. Most small to medium size boats would not have room on board to store either bow seats or hard deck panels.

2. Foredeck Stairway Conversion

The Foredeck Stairway Conversion uses the same basic principle of multi-purpose deck panels as the Cuddy Cruiser/Open Bow Conversion. Several deck sections are arranged next to each other (probably but not necessarily front to back) and fold down into the cabin area similar to a folding stepladder. The number of panels depends on the decks height above the cabin floor. When closed the multi-purpose panels become hard deck panels and close the front deck area. When folded down into the stairway arrangement, they become the stairsteps and open a large area in the deck for access which eliminates the need for a hatch. These panels could be made any practical width thus providing wide open, easy, safe access to the front deck area, even for less mobile people such as senior citizens. This design will allow almost any person to easily reach the front deck area of small to medium size boats. Easy access to the front deck will greatly enhance the utility of these boats by providing easier line handling when mooring or docking, additional highly desirable seating areas, and the ability to enter and exit the boat over the bow when in tight moorings, or when beaching.

DESCRIPTION OF A PREFERRED EMBODIMENT

The invention relates to the use of multi-purpose panels which are integrated into a boat deck. These panels can be either opened or closed. When open they provide a useful function such as seats or ladders, and when closed, they become part of the boats deck.

Figure 1:
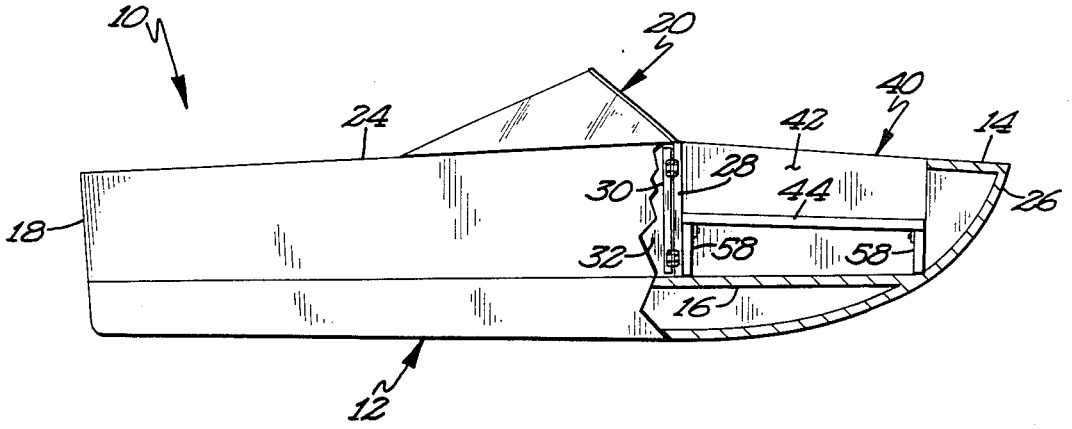
FIG. 1 is a line sketch side cutaway view of a typical runabout boat showing general layout and the area where the seats and cuddy cabin are located.

Referring now in more detail to the drawings, FIG. 1 shows the outline of a boat showing the location of the seating area in the bow. This is also the cabin area depending on the position of the multi-purpose deck panels (up and closed for deck, down and open for seats). The boat's windshield 20 bottom 12 transom 18 and floor 16 will help outline the position of the front seating area. The invention pertains to the deck section above the seats 40 and the seats themselves 44.

Figure 2:
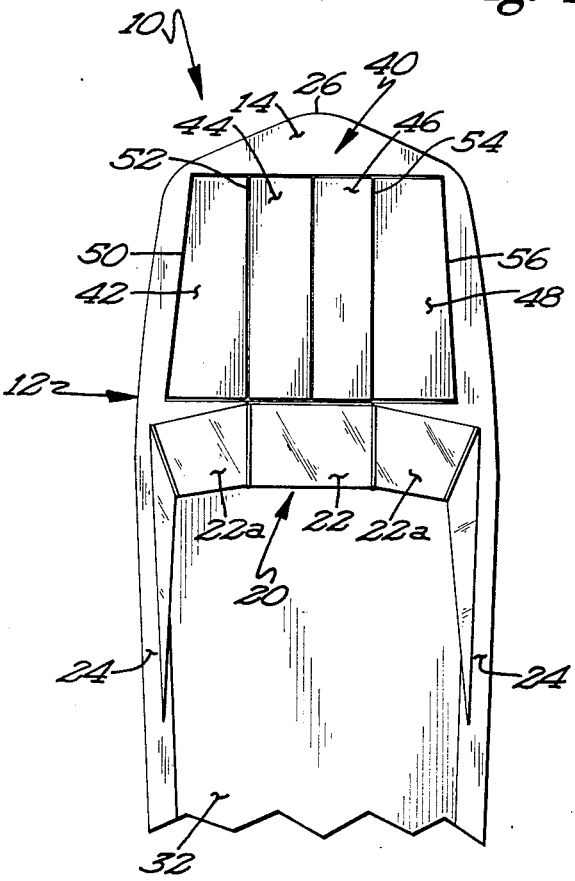
FIG. 2 is a top view of the front part of the boat showing the multi-purpose deck panels 42 44 46 and 48 closed and forming the hard deck.

FIG. 2 is a top view of the forward portion of the boat outlined in FIG. 1 The four rectangles labeled 42 44 46 and 48 are the multi-purpose deck panels and are shown closed and forming a large portion of the front deck.

The boat is further defined by the windshield 20 and the gunwales 24. Access to the front deck area is through a center walk-thru and a hinged windshield center section 22 that can be easily opened or closed. The cockpit area of the boat 32 is unaffected and can be arranged in any conventional layout the designer chooses.

Figure 3:
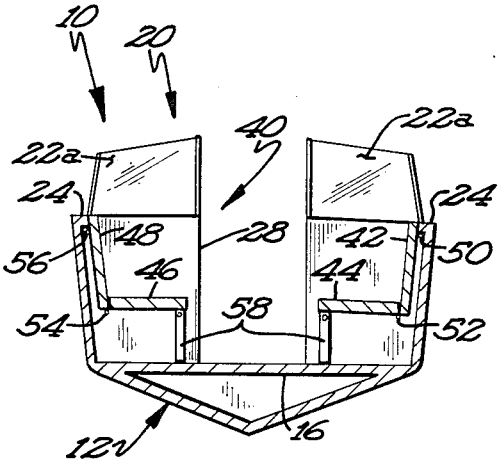
FIG. 3 is a cross section through the bow area showing the multi-purpose deck panels 42 44 46 and 48 lowered to form seats.

FIG. 3 shows a cross section of the bow area of the boat with the multi-purpose deck panels 42 44 46 and 48 open and forming seats. With reference back to FIG. 2, panels 42 and 48 when closed are the panels nearest the outside of the boat, one on each side. Panels 44 and 46 are in the center, one on each side. When the multi-purpose deck panels are lowered to become seats, panels 42 and 48 become the seat backs and panels 44 and 46 become the seats themselves. This design shows leg supports 20 extending from the seat to the deck 58. This is only intended as an example. There are many ways to support the seats depending on the boat's cabin design. Free access to the bow area is through the center walk-thru (22). The center hinged part of the windshield is shown open. The boat is further defined by the deck 16 and the hull 12.

Figure 4:
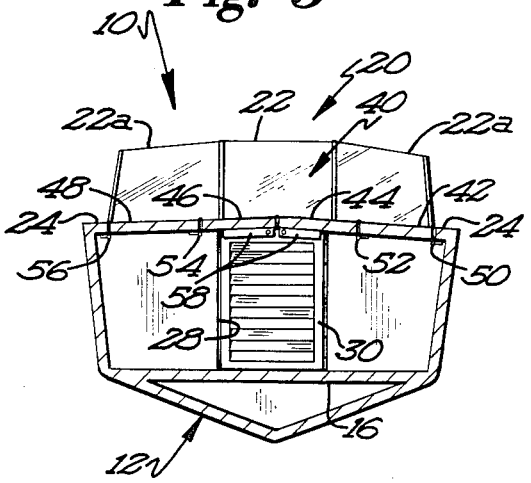
FIG. 4 is a cross section through the bow area showing the multi-purpose deck panels 42 44 46 and 48 raised to form the closed deck.

FIG. 4 shows the same cross section of the bow area of the boat in FIG. 3, but with the multi-purpose deck panels 42 44 46 and 48 raised to close up the bow area by becoming the front deck. Note the wide open front cabin area. With the multi-purpose deck panels raised to become the deck, there are no seats to infringe on cabin space or to be removed and stored or left behind on shore. Here the center windshield section 22 and a cabin door 30 are both shown closed. With the multi-purpose deck panels up and the cabin door closed, the front cuddy cabin is completely enclosed providing weather protection, privacy, and security. When left unattended, the cabin area can be closed up and locked to provide protection for valuable equipment and personal belongings.

The specific construction details will vary widely depending on the particular hull, deck and cabin design for any boat, but a typical construction might consist of the following:

Waterproof hinges at points 50 52 54 and 56 and running the length of the panels, connecting panels 42 and 48 to the outer hull and panels 44 and 46 to panels 42 and 48 respectively. Latches would be used to lock the panels in place in either open bow seating or closed deck cabin arrangements. Panels could be made from nearly any strong material such as fiberglass, aluminum, wood, plastic or steel and would not have to be of the same material as the deck and hull. Appropriate interlocking flanges would be used to waterproof the ends of the panels as with many conventional boat hatches. A wide variety of support structures is possible from folding legs to molded in permanent supports, again dependent on the particular boat and designer.

Operation—To make the conversion, the latches are released and the panels are moved by hand or mechanical actuator to the other configuration. Conventional springs can be employed to help support the panel weight if needed. When in the desired position, the latches are re-locked. Since there is nothing to remove and store on board, a typical conversion should only require a few seconds to accomplish, even by unskilled passengers.

The use of multi-purpose deck panels is not restricted to open bow/cuddy cabin conversions. A second arrangement using the same invention would provide easy, safe access to the deck of small cruisers and the like. While the invention is illustrated as providing access to the front desk, it could be used to provide access to other areas such as engine compartments, flying bridges, and cabins.

Figure 5:
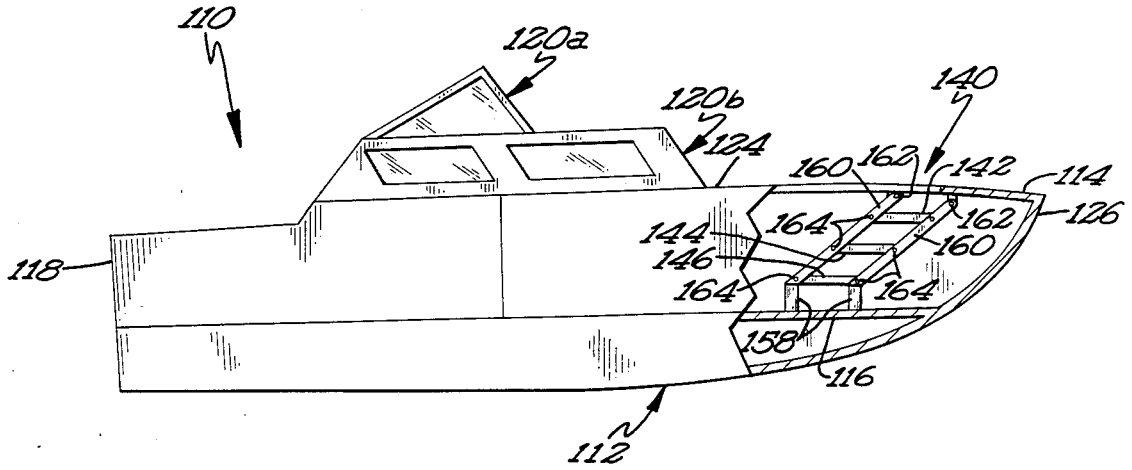
FIG. 5 is a line sketch side view of a small cruiser showing general layout of a foredeck stairway conversion 140 located in the bow.
Figure 6:
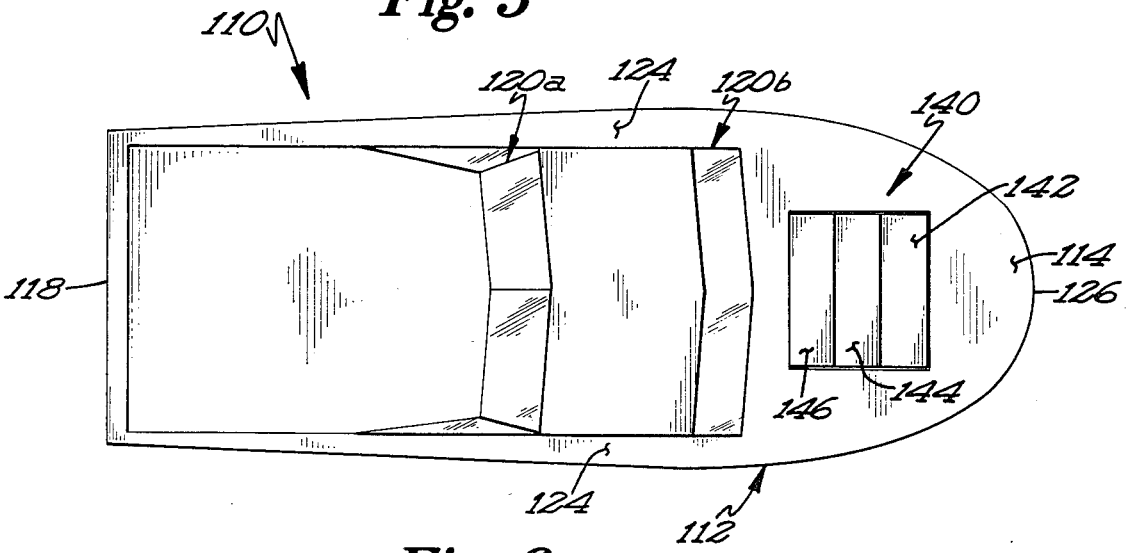
FIG. 6 is a top view of the front half of a cruiser showing the multi-purpose panels 142 144 and 146 forming a portion of the foredeck.

FIG. 5 illustrates a side cutaway view of a small cabin cruiser and shows the location of a front deck access stairway using multi-purpose deck panels 140. In FIG. 6, sections 142 144 and 146 illustrate the multi-purpose deck panels in the closed position forming part of the front deck. A simple support structure similar to a folding stepladder and attached with hinges at appropriate points 164 connect the panels together and attach them to the front deck. The various drawings are further defined as to layout relative to the windshield 120 the cabin floor 116 and the boats hull 112.

Figure 7:
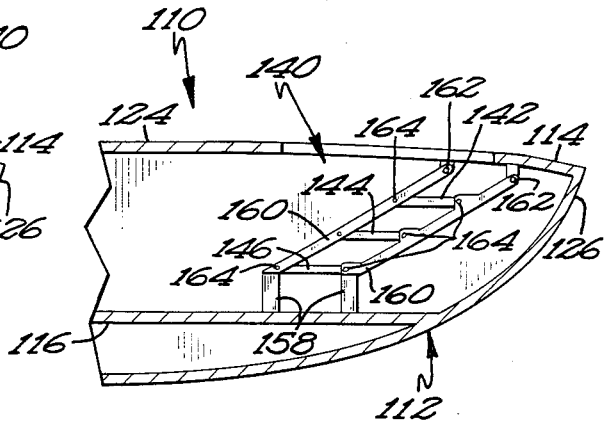
FIG. 7 is a cross section of the bow area of the cruiser showing the multi-purpose panels 142 144 and 146 as steps and the large access opening provided when the multi-purpose panels are lowered.

FIG. 7 is a cutaway of the cruiser bow area showing the multi-purpose deck panels 142 144 and 146 in the open configuration forming steps. Vertical legs 158 provide additional support for the stairway structure and are folded against the bottom of the deck panels when not in use. The support structure 160 also folds flat against the top of the cabin when the steps are raised to form the deck so as not to infringe on cabin space as illustrated in FIG. 8.

Figure 8:
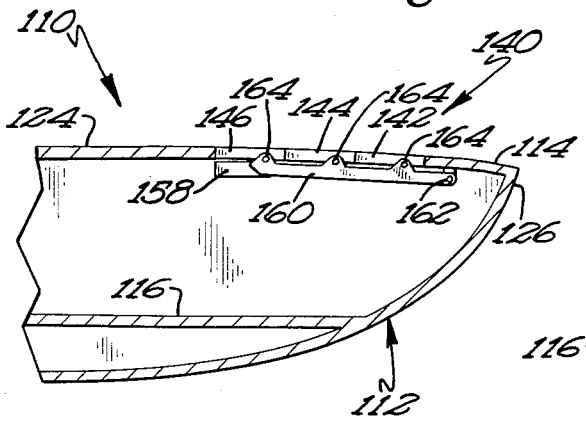
FIG. 8 shows the same cross section area as shown in FIG. 7, but with the multi-purpose deck panels 142 144 and 146 in the raised position closing the front deck access area and forming a portion of the front deck.

FIG. 8 shows the multi-purpose deck panels 142 144 and 146 in the closed position, forming part of the front deck and sealing the access area to provide weather protection and security. Note the unobstructed cabin area 116. Since the steps and support structure are raised to become part of the front deck and to close and seal the stairway access area, there is no ladder or similar device to be removed and stored on board or left behind on shore when not in use. The need for conventional hatches is eliminated since a large access area is provided when the deck sections are lowered to form steps. Since the deck panels can be made any size the designer wishes, the access area can be made any practical size. With the deck sections forming wide steps, access to the bow will be considerably easier and much safer than through conventional hatches or around the edge of cabins.

The specific hardware used to support the various multi-purpose deck panel arrangements such as hinges, latches, legs and springs will vary with each design. The panels themselves can be easily manufactured from many readily available materials such as fiberglass, aluminum, wood, plastic, or steel.

What is claimed is:

1. In combination with an open bow boat, a convertible structure for attachment to the boat and being shiftable between a deck forming position and a seat forming position, said convertible structure including two pairs of generally rectangular-shaped substantially flat panels having longitudinal edges, the panels comprising each pair being hingedly connected along adjacent longitudinal edges, said convertible structure, when in the deck forming position, having one panel of each pair being secured to the gunwale of the boat adjacent the bow area, the other respective panels of said pairs being secured together, whereby said panels are arranged in extended horizontal relation to define a deck, said convertible structure, when in the seat forming position, having each panel of one pair being connected to the gunwale adjacent the bow area and extending substantially vertically downwardly therefrom, the other panel of each pair extending in right angular horizontal relation with respect to the associated one panel so that the panels of each pair define a seat, and latch means engaging the horizontal panel of each pair for supporting the latter in the seat forming position and similar latch means for supporting each panel in the deck forming position.

2. In combination with a boat having a cabin and having an opening in the deck defining the roof of the cabin, a convertible structure for attachment to the boat for selectively providing a closure for the deck opening and, alternatively, providing steps for access to the bow of the boat, said convertible structure including a plurality of generally rectangular-shaped substantially flat panels having longitudinal edges, support structure means connecting the panels together along adjacent longitudinal edges, said convertible structure, when in deck forming position, having one of said panels secured to the boat adjacent the bow so that said panels are arranged in front to rear side-by-side relation, and means securing the rearmost panel to the cabin deck at a location aft of the connection of said first-mentioned panel so that said panels are horizontally disposed and close the open section in the deck, said convertible structure, when in the step forming position, having said one panel disposed in horizontal relation and having each adjacent panel disposed in a substantially horizontal decending relation to thereby define a series of steps located at the bow of the boat.

* * * * *